US005466073A

United States Patent [19]

Rossi et al.

[11] Patent Number: 5,466,073

[45] Date of Patent: Nov. 14, 1995

[54] PRINTER RIBBON CARTRIDGE WITH RE-INKING RESERVOIR AND PUMP

[75] Inventors: Giorgio Rossi; Michael L. Ritrovato, both of Hummelstown; Gregory E. Johnson, Halifax, all of Pa.

[73] Assignee: Advanced Supplies, Inc., Middletown, Pa.

[21] Appl. No.: 327,850

[22] Filed: Oct. 21, 1994

[51] Int. Cl.[6] ..... B41J 31/00; B41J 32/02

[52] U.S. Cl. ..... 400/197; 400/202; 400/202.2; 400/202.1; 400/208; 400/185; 400/196.1

[58] Field of Search ..... 101/196.1, 197, 101/200, 202, 202.1, 202.2, 202.3, 202.4, 208, 185, 470, 471.1

[56] References Cited

U.S. PATENT DOCUMENTS

| | | | |
|---|---|---|---|
| 1,841,139 | 1/1932 | Muller . | |
| 2,005,503 | 6/1935 | Pelton . | |
| 2,530,697 | 11/1950 | Higgins . | |
| 2,695,092 | 11/1954 | Pelton . | |
| 2,724,489 | 11/1955 | Fields . | |
| 4,449,838 | 5/1984 | Okamura et al. . | |
| 4,456,393 | 6/1984 | Gomi et al. | 400/470 |
| 4,679,058 | 2/1987 | Hori | 400/197 |
| 4,690,576 | 9/1987 | Cory . | |
| 4,974,977 | 12/1990 | Morgan et al. | 400/208 |
| 5,054,943 | 10/1991 | Cheng . | |
| 5,137,382 | 8/1992 | Miyajima . | |
| 5,207,519 | 5/1993 | Debreczenyi . | |
| 5,221,148 | 6/1993 | Suzuki et al. | 400/470 |
| 5,314,257 | 5/1994 | Cheng . | |

*Primary Examiner*—Edgar S. Burr
*Assistant Examiner*—Lynn D. Hendrickson
*Attorney, Agent, or Firm*—Stevens, Davis, Miller & Mosher

[57] ABSTRACT

A ribbon cartridge for an impact printer includes a liquid ink container, a metering/transfer device such as a peristaltic pump, an ink reservoir pad, and an ink transfer roller. The metering/transfer device and a drive roller for the ribbon preferably receive motive power from a common source. With this arrangement, the cartridge carries a large quantity of ink and applies it to the fabric in a controlled manner, thus extending service life and improving operability of the cartridge.

6 Claims, 3 Drawing Sheets

PRINTER RIBBON CARTRIDGE WITH RE-INKING RESERVOIR AND PUMP

BACKGROUND OF THE INVENTION

This invention relates to inked ribbon cartridges and more particularly to cartridges used in high speed shuttle matrix printers and having re-inking systems.

DESCRIPTION OF THE PRIOR ART

In an impact printer such as a dot-matrix printer or a daisy-wheel printer, a ribbon cartridge is commonly used for storing inked fabric in a storage chamber from which the inked fabric may be withdrawn for printing. Also, on occasion, this type of ribbon cartridge incorporates a fabric re-inking system which allows stored ink to be transferred to the stored fabric, thereby re-inking the fabric and extending the service life of the ribbon cartridge. Conventional re-inking systems will be explained in more detail below.

In high speed shuttle matrix printer ribbon cartridges of this type, the ribbon is passed through the nip between a drive roller and a driven roller or between a drive roller and a flat metal spring. Through this nip the fabric enters a storage chamber. From this storage chamber the fabric exits through the exit arm and passes in front of one or many print heads consisting of print wires or small metal arms which press against the inked fabric onto a substrate to produce a series of dots which form graphics or printed characters on the substrate. The fabric is continuously moved by the drive roller past the print position and back into the storage chamber by way of an entrance arm.

An obvious problem with this mechanism is that as the cartridge is used, the ink held within the fabric is consumed. Over time, as the fabric is continuously moving, the ink saturation level of the fabric decreases and makes the print quality very light and unreadable. This situation is referred to as the end of service life of the ribbon cartridge.

By several means service life of a ribbon cartridge may be extended. One possibility would be to increase the initial ink saturation level of the fabric. This, however, can cause undesirable smudging of characters on the substrate during initial printing.

Another means of extending service life of a ribbon cartridge is to incorporate into the ribbon cartridge a fabric re-inking system. These types of systems generally consist of a transfer roller and an ink reservoir pad.

The transfer roller makes contact with both the fabric and the ink reservoir pad. Its function is to regulate the amount of ink being transferred to the fabric. Too much ink in one place on the fabric will cause hot spots which can lead to a light and dark print condition or character smudging. Too little ink on the fabric can lead to the print density being too light and cause a premature end to service life.

The ink reservoir pad is generally made of coarse felt or open-celled foam. It suspends the ink within itself, and as pressure is applied to it from the transfer roller, it releases the ink onto the roller which, in turn, dispenses it to the fabric. Unfortunately, such pads are quite voluminous and due to space constraints within the ribbon cartridge the pads cannot be made large enough to hold a sufficient amount of ink effectively to increase the service life while reducing the cost per printed character ratio of the ribbon cartridge.

In addition to these concerns, as the fabric's ink saturation level is reduced and the fabric dries out, the individual fibers which make up the fabric begin to deteriorate and crush.

Eventually, if this condition persists, the fabric will fall apart, thereby causing the mechanism to jam and fail. Through testing it has been found that the oils in the ink act as a lubricant between the print wires or metal arms and the fabric. When the lubrication is sufficient, the fabric's fibers are less likely to crush and to cause the ribbon cartridge to fail.

SUMMARY OF THE INVENTION

It is an object of the invention to provide a ribbon cartridge with a re-inking system which extends the service life of the ribbon cartridge while reducing the cost per printed character ratio.

It is a further object of the invention to maintain an acceptable ink saturation level and thus to avoid hot spots and facilitate the lubrication of the fabric.

It is a further object of the invention to hold a large quantity of liquid ink in the re-inking system.

To these and other objects, the preferred re-inking system includes but is not limited to a transfer roller, an ink reservoir pad, a liquid ink container and a metering/transfer device.

As stated previously, ink reservoir pads are voluminous and can only hold a limited amount of ink. However, a larger amount of liquid ink can be held in a container such as a poly bag and still fit within the constraints of available space within the ribbon cartridge. The liquid ink container can be attached to the ink reservoir pad by means of a tube to replenish the ink in the reservoir pad as it is removed by the transfer roller. A metering/transfer device (such as a peristaltic pump) is placed along the tube between the container and the reservoir pad to push the ink to the reservoir pad. The pump is also the metering device; it governs the amount of ink being delivered to the reservoir pad. Speed, which is the governing property of the pump, is obtained through a gear train driven by the capstan drive attached to the printer. As the capstan drive is also what governs the speed of the fabric, a constant ratio is maintained between fabric speed and pump delivery rate.

DETAILED DESCRIPTION OF THE PREFERRED EMBODIMENT

Figure 1:
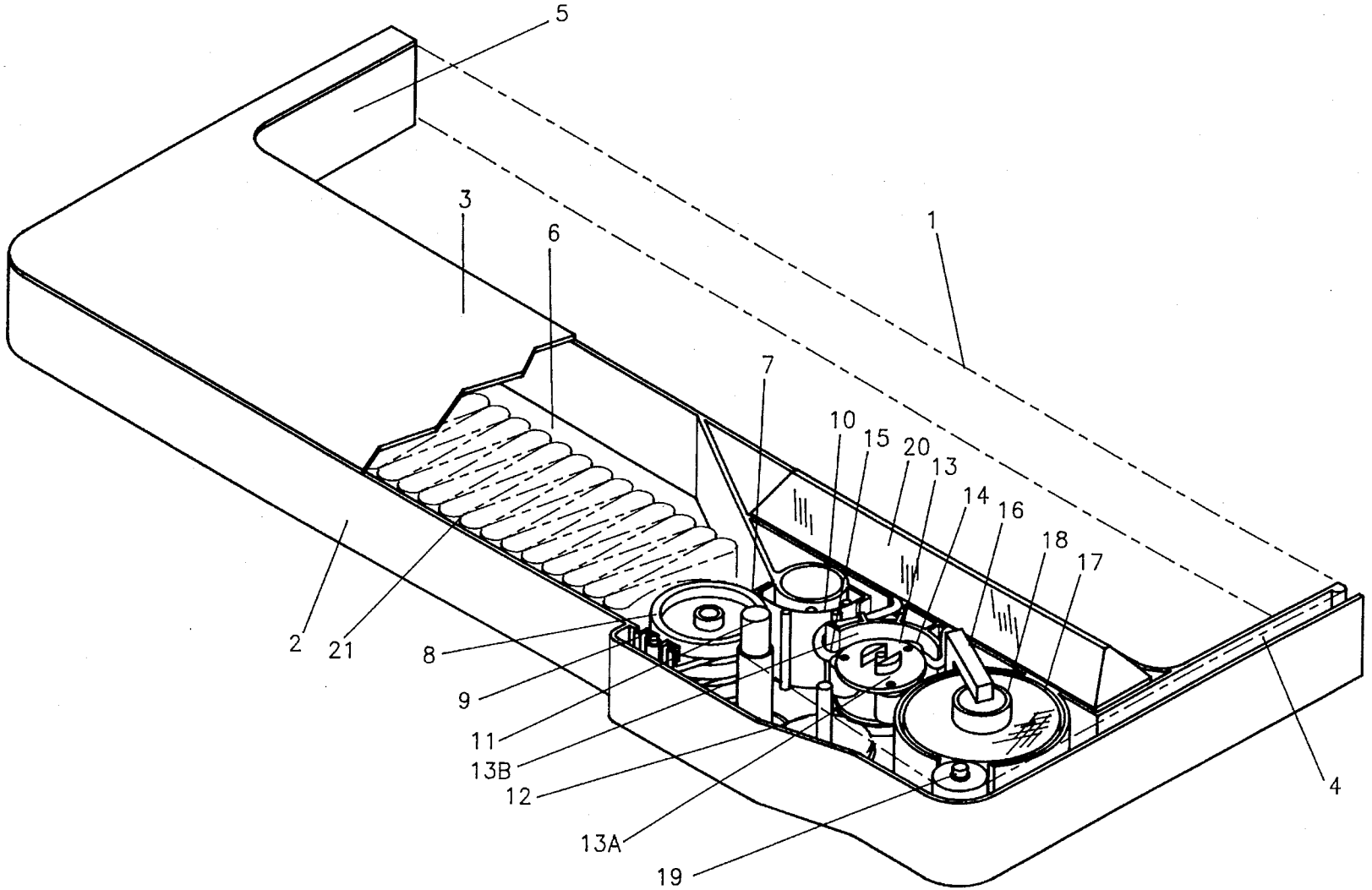
FIG. 1 is a perspective view of the top, front and right side of the re-inking system in the ribbon cartridge according to the preferred embodiment of the invention.
Figure 2:
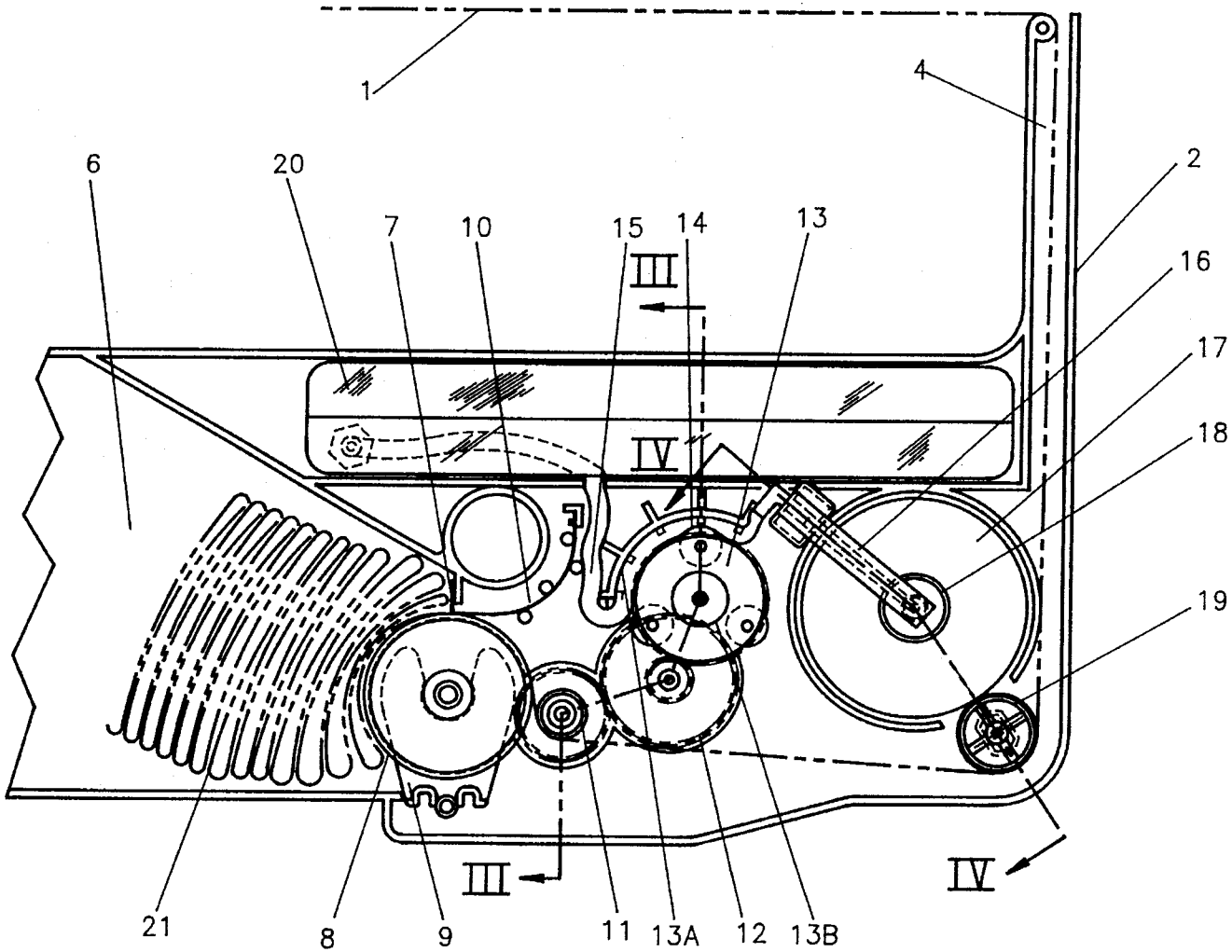
FIG. 2 is a top or plan view of the re-inking system shown in FIG. 1.
Figure 3:
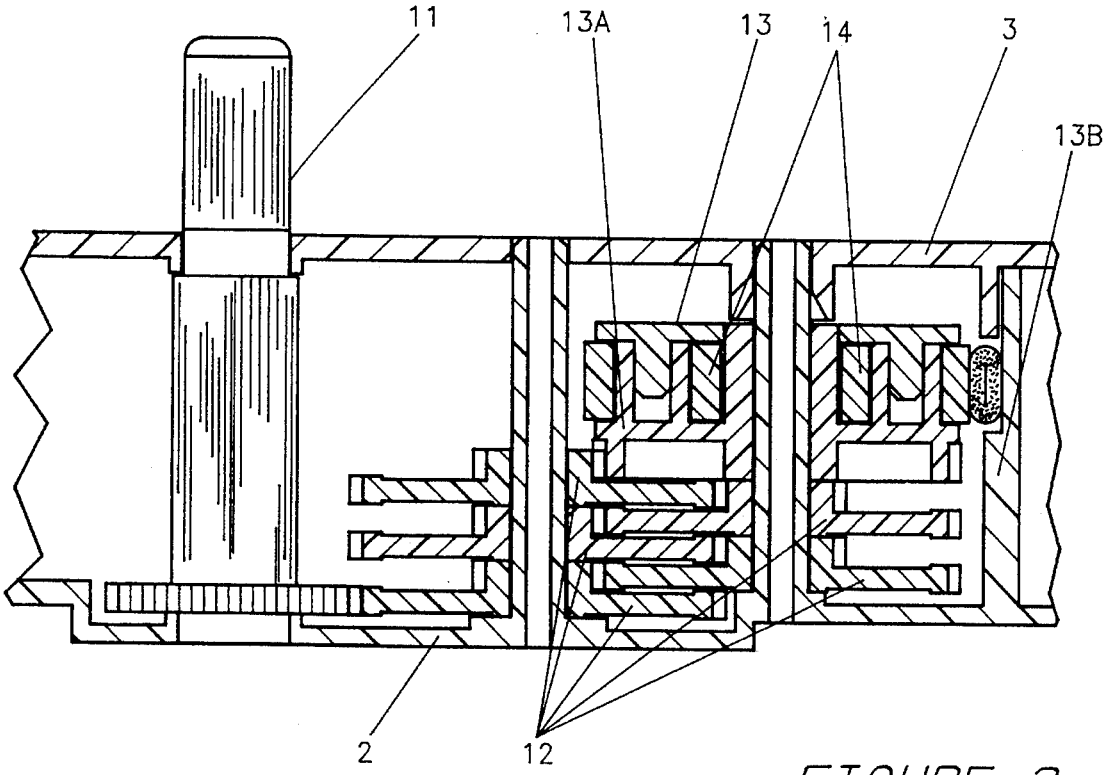
FIG. 3 is a sectional view taken on line 3—3 of FIG. 2 showing the capstan drive, gear train, and pump mechanism.
Figure 4:
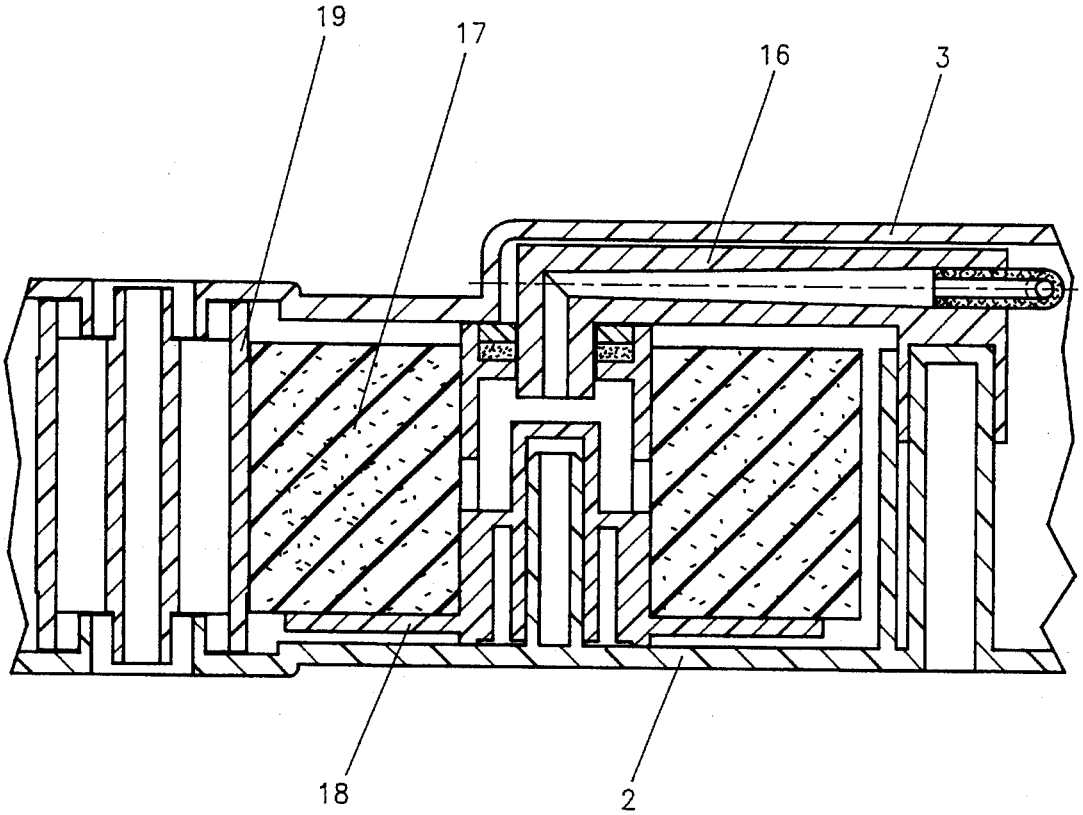
FIG. 4 is a sectional view taken on line 4—4 of FIG. 2 showing the ink block, ink reservoir pad, and transfer roller.

The preferred embodiment is shown in FIGS. 1–4. Fabric 1 is housed in a cartridge formed by cartridge base 2 and cartridge top 3 (shown as partially cut away). The cartridge has entrance arm 4 and exit arm 5; part of the fabric extends between these arms. Another part of the fabric is held in fabric storage area 6 as ribbon fanfold 21. In entering the fabric storage area, the fabric passes through nip 7 between drive roller 8 and drive spring 10. Drive roller 8 is provided with stripper 9 to strip off any excess ink which might have been transferred to drive roller 8 from fabric 1. The cartridge also includes capstan drive 11 for receiving motive power from outside the cartridge and five gear train gears 12 for transmitting the motive power.

The gear train gears drive pump 13, which is the ink measuring/transfer device. The pump has a curved stationary member 13B and a rotor 13A which carries at least one tube compression roller 14 mounted on it; each roller is preferably mounted for rotation about its own axis. As the rotor 13A turns, the tube compression rollers 14 massage ink tube 15 and press it against the stationary member 13B to induce ink flow from liquid ink container 20 through the ink tube by peristaltic action. The tube wall has sufficient resilicency to restore to at least a partially round cross-section so as to refill more readily with ink. The liquid ink container 20 is preferably in the form of a totally enclosed flexible walled bladder, and the walls collapse as the ink is withdrawn from the bladder, which can be of any size and shape to fit within the available space. The ink flows through the ink tube into ink conduit 16, which is a plastic block with an opening extending therethrough, to re-ink ink reservoir pad 17, which is mounted on reservoir pad hub 18 and is preferably totally enclosed to prevent the ink from drying out. Part of the surface of transfer roller 19 is in contact with reservoir pad 17 and is wetted by it. As the transfer roller rotates, the wetted portion transfers its ink from the ink reservoir pad to the fabric, thus ensuring even application. The rollers 14 preferably have equal diameters and are located at the same distance from a rotational axis of the rotor, so that they each exert equal pressure on the ink tube, although it is also contemplated that the diameters or the spacing could be varied to exert a step-wise squeezing of the ink tube 15. The rollers 14 can have flanges to limit the vertical movement of the ink tube along the stationary member. All parts are preferably made of plastic.

The preferred embodiment operates in the following manner. When the cartridge is set in the printer, a motor in the printer rotates the capstan drive 11. The capstan drive in turn rotates the drive roller 8 and the gear train gears 12. The drive roller pulls the fabric through the cartridge so that the portion of the fabric between the entrance arm 4 and the drive roller 8 is under tension. The portion of the fabric 1 downstream from the entrance arm 4 thus moves continuously in front of the print head. Thus the fabric 1 as it contacts the periphery of transfer roller 19 is under tension and pressed against the roller 19 so as to pick up ink therefrom. Adjacent to drive roller 8, on the side opposite the tensioned portion of fabric 1, is a stripper 9 to strip off any excess ink which may have transferred from fabric 1 to drive roller 8.

Upstream from drive roller 8 and capstan 11, the fabric is pushed in a fan fold manner into the ribbon fan fold storage area 21 and is subsequently pulled therefrom by the portion of the fabric which extends from entrance arm 4 to exit arm 5, that portion also being under tension. The gear train gears 12 turn the rotor of the pump, thus supplying ink to the ink reservoir pad. Because the capstan drive turns both the drive roller and the pump, a constant ratio is maintained between the fabric speed and the pump delivery rate.

What is claimed is:

1. A ribbon cartridge for a printing device, the ribbon cartridge comprising:

a cartridge case having entrance and exit portions;

a ribbon having a first portion disposed within the ribbon cartridge case and a second portion disposed outside the cartridge case and extending between the entrance and exit portions;

an ink reservoir disposed within the cartridge case;

a capstan for receiving motive power from the printing device;

ribbon re-inking means, disposed within the cartridge case, for supplying ink from the ink reservoir to the ribbon; and a pump, disposed within the cartridge case and connected to receive motive power from the capstan, for pumping the ink from the ink reservoir to the ribbon re-inking means.

2. A ribbon cartridge as in claim 1, wherein the ribbon reinking means comprises a flexible ink tube extending from the ink reservoir.

3. A ribbon cartridge as in claim 2, wherein the pump comprises:

a stationary member;

a rotor which is rotated by the motive power from the capstan; and a plurality of tube compression rollers, mounted on the rotor to move when the rotor is rotated, for pressing the flexible ink tube against the stationary member to cause a peristaltic pumping action in the flexible ink tube.

4. A ribbon cartridge as in claim 2, wherein the ribbon reinking means further comprises:

an ink conduit for receiving the ink as the ink is pumped through the flexible ink tube;

a reservoir pad hub mounted on an inside surface of the cartridge case;

a reservoir pad mounted on the reservoir pad hub and adapted to receive the ink from the ink conduit; and a transfer roller, mounted on the inside surface of the cartridge case to be in contact with the reservoir pad, for transferring the ink from the reservoir pad to the ribbon.

5. A ribbon cartridge as in claim 1, further comprising:

a drive roller, positioned adjacent to the capstan to receive motive power from the capstan, for pulling the ribbon through a portion of the ribbon cartridge; and a drive gear train for transmitting motive power from the capstan to the pump;

whereby a rotational speed of the drive roller is directly proportional to an operational rate of the pump.

6. A ribbon cartridge as in claim 3, further comprising:

a drive roller, positioned adjacent to the capstan to receive motive power from the capstan, for pulling the ribbon through a portion of the ribbon cartridge; and a drive gear train for transmitting the motive power from the capstan to the pump;

whereby a rotational speed of the drive roller is directly proportional to a rotational speed of the rotor.

* * * * *